US007422482B2

(12) United States Patent
Wang

(10) Patent No.: US 7,422,482 B2
(45) Date of Patent: Sep. 9, 2008

(54) ELECTRICAL CONNECTOR HAVING IMPROVED SHIELD

(75) Inventor: Long-Fei Wang, ShenZhen (CN)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,524

(22) Filed: Aug. 1, 2007

(65) Prior Publication Data

US 2008/0032553 A1 Feb. 7, 2008

(51) Int. Cl.
*H01R 13/648* (2006.01)

(52) U.S. Cl. ..... 439/607; 439/71

(58) Field of Classification Search ..... 439/607, 439/71

See application file for complete search history.

(56) References Cited

U.S. PATENT DOCUMENTS 5,462,440 A * 10/1995 Rothenberger ..... 439/66
5,484,295 A * 1/1996 Mowry et al. ..... 439/66
5,975,914 A * 11/1999 Uchida ..... 439/66
5,975,959 A * 11/1999 Joly ..... 439/630
6,345,987 B1 * 2/2002 Mori et al. ..... 439/66
6,375,474 B1 * 4/2002 Harper et al. ..... 439/66
6,862,804 B2 * 3/2005 Nishio et al. ..... 29/840
6,923,657 B2 * 8/2005 Brown et al. ..... 439/71
6,939,172 B2 * 9/2005 Lu ..... 439/607
6,994,565 B2 * 2/2006 Harper, Jr. ..... 439/66
7,011,555 B2 * 3/2006 Pan ..... 439/862
7,044,746 B2 * 5/2006 Copper et al. ..... 439/66
7,077,664 B1 * 7/2006 Wang et al. ..... 439/70
7,086,902 B1 * 8/2006 Yang ..... 439/607
7,090,546 B2 * 8/2006 Zheng et al. ..... 439/862
7,097,466 B2 * 8/2006 Asai ..... 439/76.1
7,112,083 B2 * 9/2006 Nishio et al. ..... 439/331
7,121,864 B1 * 10/2006 Yang ..... 439/331
7,128,607 B2 * 10/2006 Li ..... 439/607
7,147,481 B2 * 12/2006 Yang ..... 439/71
7,147,510 B2 * 12/2006 Asai et al. ..... 439/607
7,153,144 B2 * 12/2006 Ohsawa et al. ..... 439/67
7,156,679 B1 * 1/2007 Wang et al. ..... 439/330
7,160,116 B2 * 1/2007 Li ..... 439/73
7,163,407 B2 * 1/2007 Nishio et al. ..... 439/70
7,168,959 B2 * 1/2007 Kuo et al. ..... 439/67
7,179,126 B2 * 2/2007 Chen ..... 439/607
7,214,083 B2 * 5/2007 Chen et al. ..... 439/330
7,223,125 B2 * 5/2007 Chen ..... 439/609
7,226,297 B2 * 6/2007 Li ..... 439/71
7,232,316 B2 * 6/2007 Chen ..... 439/71
7,232,327 B2 * 6/2007 Asai et al. ..... 439/331
7,241,160 B2 * 7/2007 Yang ..... 439/330
7,255,600 B2 * 8/2007 Ma ..... 439/607
7,261,597 B2 * 8/2007 Li ..... 439/607
7,261,599 B2 * 8/2007 Li ..... 439/608
7,281,954 B1 * 10/2007 Hashiguchi ..... 439/660

(Continued)

*Primary Examiner*—Ross N Gushi
(74) *Attorney, Agent, or Firm*—Wei Te Chung

(57) ABSTRACT

An electrical connector (100) includes a lower shield (3), an insulative housing (1) assembled to the lower shield, a number of terminals (2) and a pair of upper shields (4). The lower shield has a bottom wall (33) and a pair of first side walls (32). Each first side wall has a pair of upper base portions (361) and a lower base portion (326) and defines a recess (325) between the upper base portions and the lower base portion. Each upper base portion has a projecting portion (363) extending outwardly therefrom through the recess for engaging with a protrusion (46) disposed on a top surface of the upper shield.

13 Claims, 2 Drawing Sheets

U.S. PATENT DOCUMENTS 7,288,003 B2 * 10/2007 Ono et al. ..... 439/607
7,309,238 B2 * 12/2007 Yang ..... 439/71
2004/0068868 A1 * 4/2004 Nishio et al. ..... 29/840
2004/0132319 A1 * 7/2004 Richter et al. ..... 439/66
2004/0247311 A1 * 12/2004 Ajiki et al. ..... 396/535
2005/0048829 A1 * 3/2005 Nishio et al. ..... 439/331
2005/0060842 A1 * 3/2005 Ibaraki et al. ..... 16/295
2005/0142917 A1 * 6/2005 Verweg et al. ..... 439/212
2005/0153600 A1 * 7/2005 Lu ..... 439/607
2005/0170674 A1 * 8/2005 Lu ..... 439/66
2005/0215087 A1 * 9/2005 Asai et al. ..... 439/71
2005/0215117 A1 * 9/2005 Asai et al. ..... 439/607
2005/0215118 A1 * 9/2005 Asai et al. ..... 439/607
2005/0219399 A1 * 10/2005 Sato et al. ..... 348/340
2005/0239302 A1 * 10/2005 Wada ..... 439/71
2006/0014405 A1 * 1/2006 Chen et al. ..... 439/78
2006/0024987 A1 * 2/2006 Huang et al. ..... 439/66
2006/0051986 A1 * 3/2006 Asai et al. ..... 439/71
2006/0063399 A1 * 3/2006 Li ..... 439/70
2006/0063431 A1 * 3/2006 Yang ..... 439/607
2006/0098969 A1 * 5/2006 Asai et al. ..... 396/89
2006/0105631 A1 * 5/2006 Yang ..... 439/607
2006/0121756 A1 * 6/2006 Kuo et al. ..... 439/76.1
2006/0189179 A1 * 8/2006 Dittmann et al. ..... 439/74
2006/0189183 A1 * 8/2006 Yang ..... 439/95
2006/0189216 A1 * 8/2006 Yang ..... 439/680
2006/0216996 A1 * 9/2006 Chen ..... 439/607
2006/0234557 A1 * 10/2006 Chen ..... 439/609
2006/0246749 A1 * 11/2006 Li ..... 439/68
2006/0246750 A1 * 11/2006 Li ..... 439/68
2006/0246762 A1 * 11/2006 Chen et al. ..... 439/331
2006/0258218 A1 * 11/2006 Chen ..... 439/607
2006/0258219 A1 * 11/2006 Chen ..... 439/607
2006/0270274 A1 * 11/2006 Li ..... 439/581
2006/0270276 A1 * 11/2006 Li ..... 439/607
2006/0276059 A1 * 12/2006 Dittmann et al. ..... 439/67
2007/0037448 A1 * 2/2007 Ma ..... 439/607
2007/0077823 A1 * 4/2007 Yang ..... 439/638
2007/0111566 A1 * 5/2007 Seibert et al. ..... 439/91
2007/0149009 A1 * 6/2007 Yang ..... 439/95
2007/0173130 A1 * 7/2007 Hashiguchi ..... 439/660
2007/0207653 A1 * 9/2007 Ono et al. ..... 439/188
2007/0232143 A1 * 10/2007 Yang ..... 439/607
2007/0232145 A1 * 10/2007 Wang ..... 439/610
2007/0238357 A1 * 10/2007 Wang ..... 439/607
2007/0287314 A1 * 12/2007 Ma ..... 439/188
2008/0014797 A1 * 1/2008 Yang ..... 439/607
2008/0026626 A1 * 1/2008 Ma ..... 439/330
2008/0032547 A1 * 2/2008 Zhang ..... 439/497
2008/0045070 A1 * 2/2008 Zheng et al. ..... 439/370
2008/0045085 A1 * 2/2008 Zhang ..... 439/607
2008/0045086 A1 * 2/2008 Zheng et al. ..... 439/626
2008/0050941 A1 * 2/2008 Zhang ..... 439/67

* cited by examiner

ELECTRICAL CONNECTOR HAVING IMPROVED SHIELD

BACKGROUND OF THE INVENTION

1. Field of the Invention

The present invention relates to a shielded electrical connector, and particularly to a shielded electrical connector in which an electrical element is fitted.

2. Description of Prior Arts

With development of miniature and multifunctional electronic devices, consumer electronics such as cell phone, Personal Digital Assistant etc., are designed to provide a camera module in virtue of an electrical connector. Generally, a shield member is assembled to the electrical connector to reduce EMI (electromagnetic interference).

U.S. Patent Application Publication No. 2006/0216996 published on Sep. 28, 2006, discloses a connector for receiving an electrical element, including an outer shield mounted to a printed circuit board, an insulative housing attached to the outer shield, a plurality of contacts fixed to the insulative housing, and an inner shell attached to the insulative housing. The inner shell has a pair of locking tabs extending outwardly for locking with retention holes disposed on the insulative housing.

However, the outer shield described above could not fasten the inner shield firmly.

Hence, it is desirable to provide an improved electrical connector to overcome the aforementioned disadvantages.

SUMMARY OF THE INVENTION

An object of the present invention is to provide an electrical connector having improved lower shield adapted for firmly fastening an upper shield.

To achieve the above object, an electrical connector for receiving therein an electrical element comprises a lower shield, a pair of insulative housings assembled to the lower shield, a plurality of terminals fixed to the insulative housings and a pair of upper shields. The pair of upper shields are assembled to the insulative housings and each comprises a body portion. The lower shield comprises a bottom wall and a pair of first side walls. Wherein each first side wall defines a recess to form a pair of upper base portions and a lower base portion. Each upper base portion has a projecting portion extending outwardly therefrom for engaging with a protrusion disposed on a top surface of the body portion.

Advantages of the present invention are to provide a lower shield formed with a pair of improved side walls, each having a pair of projecting portions engaging with the corresponding protrusion disposed on the upper shield for fastening the upper shield to the lower shield tightly.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
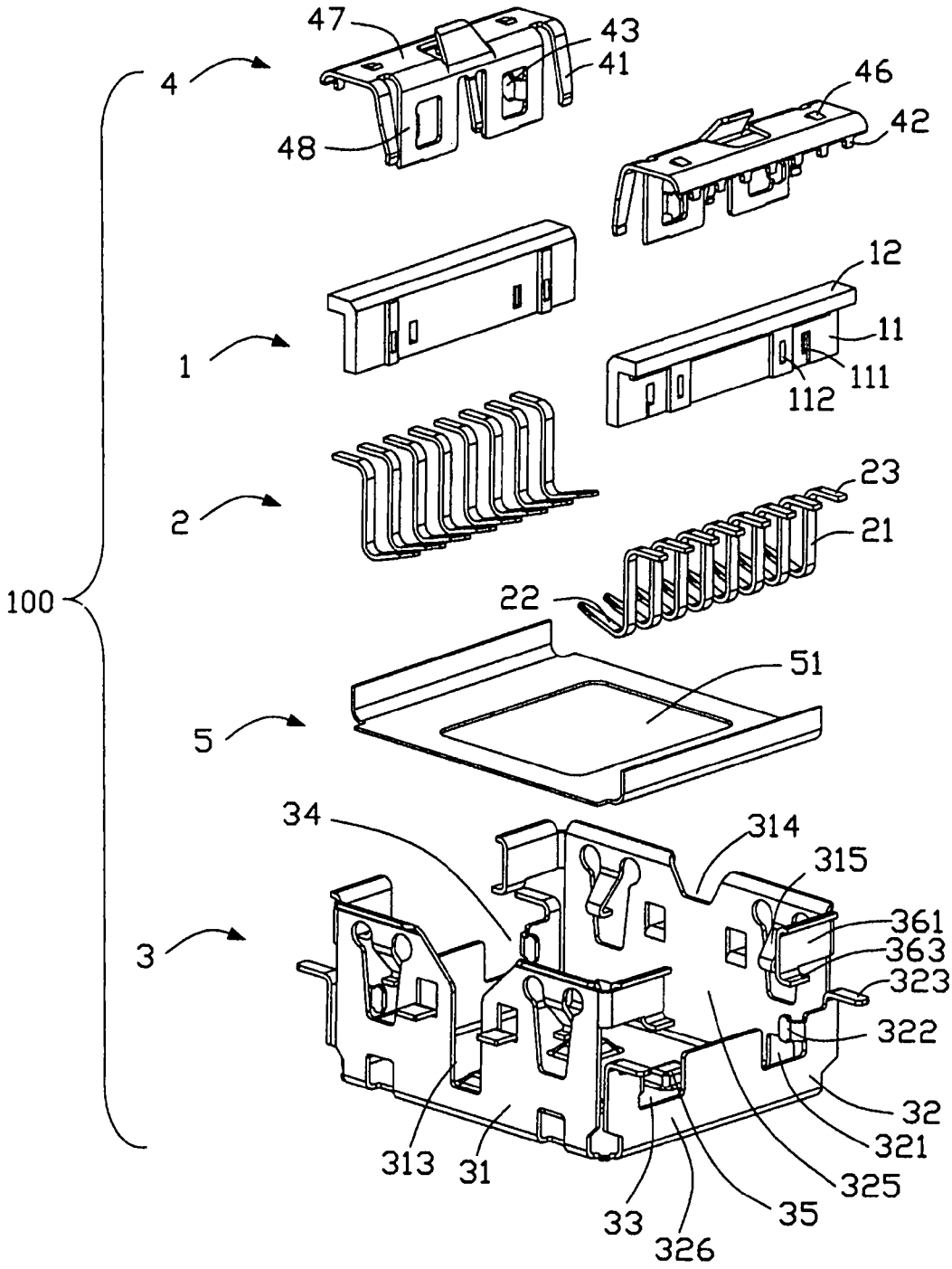
FIG. 1 is an exploded perspective view of an electrical connector in accordance with the present invention.
Figure 2:
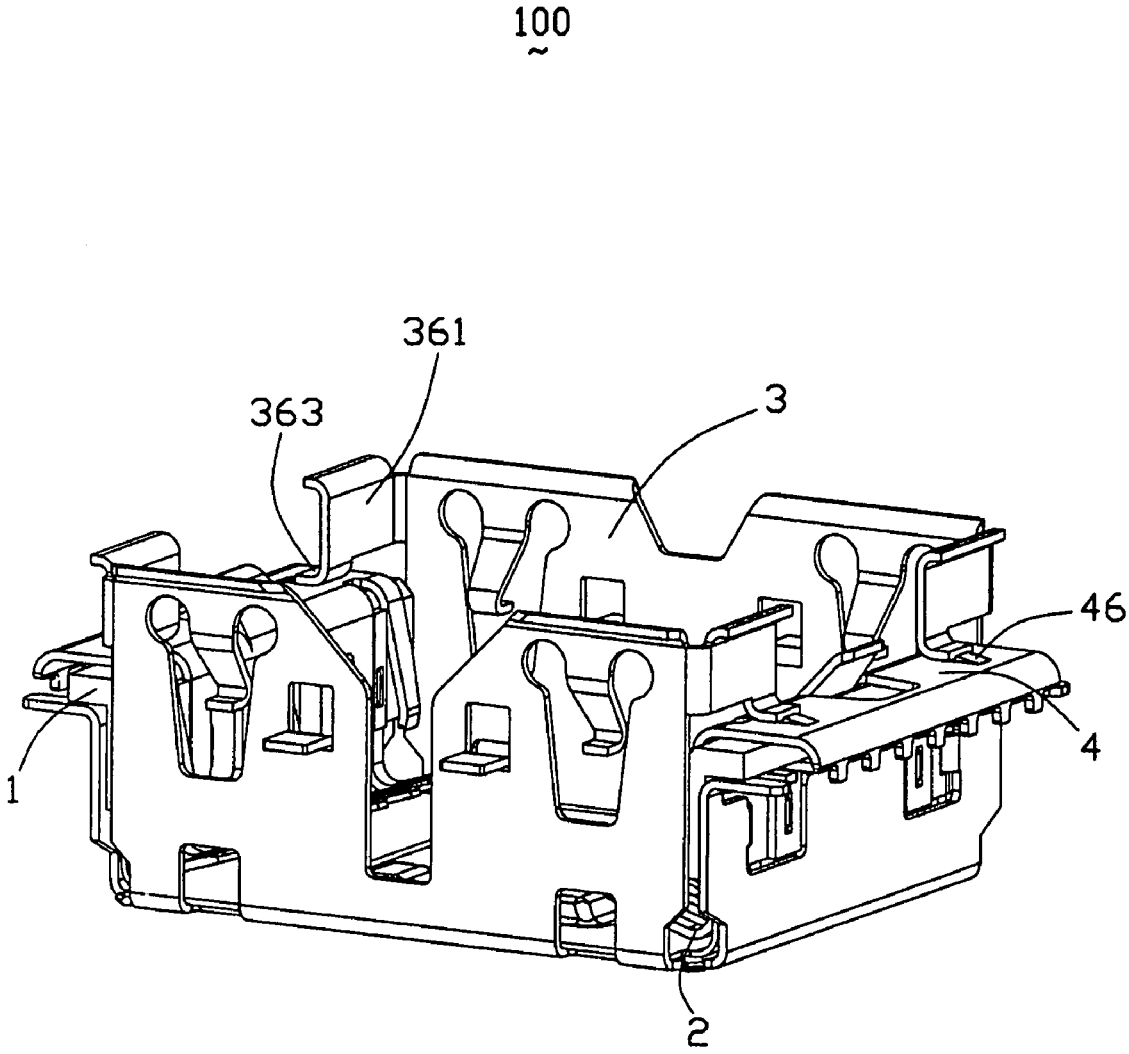
FIG. 2 is an assembled perspective view of the electrical connector as shown in FIG. 1.

Reference will now be made to the drawing figures to describe the present invention in detail. Referring to FIGS. 1-2, an electrical connector 100 in accordance with the present invention is adapted for electrically connecting an electrical element (not shown) to a printed circuit board (not shown). The electrical connector 100 comprises a pair of insulative housings 1, a plurality of terminals 2 fixed to the insulative housing 1 by insert molding, a pair of upper shields 4 attached to the insulative housing 1 and a lower shield 3 for receiving the insulative housing 1.

The insulative housing 1 includes a main portion 11 and a bending portion 12 extending laterally from an upper edge of the main portion 11. The main portion 11 is provided with a locking hole 111 for locking with the lower shield 3 and a retention hole 112 for engaging with the upper shield 4.

The terminals 2 are configured in a "Z"-shape. Each terminal 2 comprises a vertical intermediate portion 21 molded with in said insulative housing 1, a contacting portion 22 extending upwardly from a bottom end of the intermediate portion 21 for contacting with electrical pads formed on a bottom face of the electrical element, and a horizontal soldering portion 23 extending laterally and outwardly from an upper end of the intermediate portion 21 and located beneath the bending portion 12 of the insulative housing 1.

The lower shield 3 includes a bottom wall 33, a pair of first side walls 32, a pair of opposite second side walls 31 and a receiving space 34 defined therebetween for receiving the electrical element. Each first side wall 32 has a pair of upper base portions 361 and a lower base portion 326 and defines a recess 325 between the upper base portion 361 and the lower base portion 326. Each upper base portion 361 has a projecting portion 363 extending outwardly from a lower edge of the upper base portion 361 through the recess 325 for engaging with a protrusion 46 disposed on the upper shield 4. The lower base portion 326 includes a pair of indentations 321 and a pair of locking bards 322 extending inwardly from the indentations 321 for engaging with the locking hole 111. The first side walls 32 are formed with a plurality of soldering tabs 323 protruding outwardly laterally for connecting with the printed circuit board. The second side wall 31 includes a plurality of resilient tabs 315 extending inwardly for fastening the electrical element. One of second side walls 31 further comprises a cutout 314 and the other second side wall 31 defines a recess 313 extending downwardly from an upper edge thereof for engaging with a guiding protrusion (not shown) formed on the electrical element. When the electrical element is inserted into the receiving space 34 in a wrong direction, a lower edge of the cutout 314 could prevent further insertion of said electrical element. The bottom wall 33 has a plurality of resilient fingers 35 disposed on an inner surface thereof for resisting against the electrical element.

The upper shield 4 is attached to the insulative housing 1 and comprises a body portion 47 extending outwardly though the recess 325 and a lateral portion 48 bending laterally downwardly from the body portion 47. The body portion 47 has a plurality of flexible plates 41 extending into the receiving space 34 for abutting against the electrical element and a pair of locking tabs 43 extending outwardly for locking with the retention holes 112 of the insulative housing 1. A plurality of grounding tabs 42 are formed on an outer edge of the body portion 47 for electrical connecting with a plurality of pads disposed on the printed circuit board.

The electrical connector 100 further comprises an insulative plate 5 made from insulative material. The insulative plate 5 is positioned on the bottom wall 33 of the lower shield 3 for insulating the terminals 2 from the bottom wall 33 of the lower shield 3. A hole 51 is defined on a central portion of the insulative plate 5 for extension of the resilient fingers 35.

In assembling the electrical connector 100, the insulative housings 1 are attached to the first side wall 32 via engagement between the locking tabs 322 of first side walls 31 and the locking holes 111 of the insulative housings 1. The main portions 11 of the insulative housings 1 and the contacting portions 22 of the terminals 2 are received in the receiving space 34 of the lower shield 3. The horizontal soldering portions 23 of the terminals 2 extend outside of the lower shield 3 through the recess 325.

Secondly, the upper shields 4 are mounted to the insulative housing 1. The bending portion 12 protrudes trough the recess 325 of the first side wall 32 and is located on the soldering tabs 323. At the same time, the projecting portion 363 of the upper base portion 36 engages with the protrusion 46 of the insulative housing 1 for firmly fastening the upper shield 4 to the first side wall 32. The locking tabs 43 of upper shields 4 are locked with the retention holes 112 of the insulative housings 1, for fastening the upper shields 4 to the insulative housings 1. In this way, bottom surfaces of the grounding tabs 42 of the upper shield 4 are coplanar with bottom surface of the horizontal soldering portions 23 of the terminals 2 and the soldering tabs 323 of the first side wall 31, for surface mounting to the pads of the printed circuit board.

When the electrical element is inserted into the receiving space 34 of the lower shield 3, the guiding protrusion of the electrical element is guided into the recess 314 of the lower shield 3. The flexible plates 41 of the lower shield 3 and the resilient tabs 315 of the lower shield 3 commonly abut against the electrical element.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving an electrical element, comprising:

a lower shield comprising a bottom wall, a pair of first side walls and a receiving space defined therebetween, wherein each first side wall has a pair of upper base portions and a lower base portion and defines a recess between the upper base portions and the lower base portion, each upper base portion having a projecting portion extending outwardly therefrom;

an insulative housing assembled to the lower shield;

a plurality of terminals fixed to the insulative housing; and an upper shield attached to the insulative housing and comprising a body portion extending outwardly though the recess, the body portion having a protrusion disposed on a top surface thereof for engaging with the projecting portion of the lower shield.

2. The electrical connector as claimed in claim 1, wherein said lower base portion has a pair of indentations defined thereon and an inwardly extending locking bard adjacent the indentation for engaging with a locking hole disposed on the insulative housing.

3. The electrical connector as claimed in claim 1, wherein said body portion of the upper shield has a plurality of downwardly extending grounding tabs.

4. The electrical connector as claimed in claim 3, wherein each terminal comprises an intermediate portion and a soldering portion extending laterally and outwardly from an upper end of the intermediate portion, and wherein said lower base portion comprises a plurality of soldering tabs protruding outwardly laterally therefrom and coplanar with the grounding tabs and the soldering portion of the terminals.

5. The electrical connector as claimed in claim 1, wherein said lower shield comprises a pair of opposite second side walls having a plurality of flexible plates extending into the receiving space for abutting against the electrical element.

6. The electrical connector as claimed in claim 5, wherein one of the second side walls comprises a recess extending downwardly from an upper edge thereof for engaging with a guiding protrusion formed on the electrical element.

7. The electrical connector as claimed in claim 1, wherein said bottom wall has a plurality of resilient fingers extending upwardly for resisting against the electrical element.

8. The electrical connector as claimed in claim 1, wherein said upper shield has a lateral portion bending perpendicularly from the body portion and a plurality of tabs extending inwardly from the body portion for resisting against the electrical element.

9. The electrical connector as claimed in claim 8, wherein said upper shield has a pair of locking tabs extending outwardly from the lateral portion for locking with a respective retention hole disposed on the insulative housing.

10. The electrical connector as claimed in claim 1, wherein said insulative housing is configured as an inverted L-shape for engaging with the lower base portion of the lower shield.

11. An electrical connector comprising:

a metallic lower shield including a plurality of side walls and a bottom wall commonly defining a receiving cavity;

an insulative plate located around the bottom wall;

at least one L-shaped insulative housing retained to one of said side walls; and one row of contacts each including a J-shaped contacting section and a horizontal tail section; wherein the contacting section is essentially sandwiched between the insulative housing and the insulative plate in the receiving cavity, while the tail extending around a middle level and exposed downwardly an exterior for mounting to a printed circuit board.

12. The electrical connector as claimed in claim 11, wherein a metallic shell positioned upon the insulative housing opposite to the contacts.

13. The electrical connector as claimed in claim 12, wherein the shell and the shield are latchably engaged with each other.

* * * * *